US012527369B2

(12) United States Patent
Drayton

(10) Patent No.: US 12,527,369 B2
(45) Date of Patent: Jan. 20, 2026

(54) SAFETY VEST WITH PROTECTION PLATES

(71) Applicant: Brady Drayton, Boston, MA (US)

(72) Inventor: Brady Drayton, Boston, MA (US)

( * ) Notice: Subject to any disclaimer, the term of this patent is extended or adjusted under 35 U.S.C. 154(b) by 8 days.

(21) Appl. No.: 18/315,793

(22) Filed: May 11, 2023

(65) Prior Publication Data

US 2024/0373956 A1 Nov. 14, 2024

(51) Int. Cl.
*A41D 13/05* (2006.01)
*A41D 13/08* (2006.01)

(52) U.S. Cl.
CPC ..... *A41D 13/0512* (2013.01); *A41D 13/08* (2013.01)

(58) Field of Classification Search
CPC ..... A41D 13/0512; A41D 13/08; A41D 13/0518; A41D 13/0587; A41D 13/0575
See application file for complete search history.

(56) References Cited

U.S. PATENT DOCUMENTS 1,489,784 A * 4/1924 O'Shea ..... A63B 71/12 2/268
1,516,981 A * 11/1924 O'Shea ..... A63B 71/12 2/268
2,517,615 A * 8/1950 Webster ..... F41H 1/02 2/2.5
2,640,987 A * 6/1953 Ehlers ..... F41H 1/02 428/524
2,743,446 A * 5/1956 Persico ..... F41H 1/02 2/2.5
2,747,190 A * 5/1956 Foster ..... F41H 1/02 2/2.5
2,748,391 A * 6/1956 Lewis, Jr. ..... F41H 1/02 2/2.5
3,130,414 A * 4/1964 Bailey ..... F41H 1/02 2/2.5
3,135,961 A * 6/1964 Roderick ..... A41D 13/015 2/92
3,395,708 A * 8/1968 Hervey ..... D21C 9/005 604/398
3,500,472 A * 3/1970 Castellani ..... A63B 71/081 2/22
3,514,786 A * 6/1970 Terwilliger ..... A41D 13/015 2/2.5
3,658,064 A * 4/1972 Pociluyko ..... A41B 13/04 604/385.24

(Continued)

*Primary Examiner* — Alissa L Hoey
(74) *Attorney, Agent, or Firm* — Lambert Shortell & Connaughton; David J. Connaughton, Jr.; Justin P. Tinger

(57) ABSTRACT

The safety vest with protection plates may comprise a torso covering garment and a plurality of protective inserts. The safety vest with protection plates may be adapted to protect a user from injury at a job site. The torso covering garment may be adapted to cover at least the user's torso. The plurality of protective inserts may be coupled to the torso covering garment and may provide a barrier between the user and a hazardous object. As non-limiting examples, the hazardous object may be a sharp object or a flying object. In some embodiments, the safety vest with protection plates may be adapted to cover the user's arms with a pair of sleeves. The pair of sleeves may provide further protection in the form of a pair of shoulder protectors, a pair of elbow protectors, a pair of forearm protectors, or any combination thereof.

17 Claims, 4 Drawing Sheets

(56) References Cited

U.S. PATENT DOCUMENTS 3,803,639 A * 4/1974 Cohen ..... F41H 1/02 2/2.5
3,945,042 A * 3/1976 Lobo ..... A41D 13/0581 2/467
3,968,798 A * 7/1976 Hokanson ..... A61F 13/505 604/397
3,973,275 A * 8/1976 Blauer ..... F41H 1/02 2/2.5
3,991,420 A * 11/1976 Savarino ..... A63B 71/12 2/268
4,425,667 A * 1/1984 Harrison ..... A41D 13/0153 2/2.5
4,485,491 A * 12/1984 Rasmussen ..... F41H 1/02 2/2.5
4,507,801 A * 4/1985 Kavanagh ..... A41D 13/015 2/267
4,535,478 A * 8/1985 Zufle ..... A41D 13/0575 2/2.5
4,680,813 A * 7/1987 Glaeser ..... A41D 13/05 2/467
4,688,269 A * 8/1987 Maeshima ..... A41D 13/0556 2/24
4,866,789 A * 9/1989 Dorm ..... A63B 71/12 2/92
4,870,706 A * 10/1989 Ketcham ..... A41D 13/0575 128/DIG. 20
4,884,295 A * 12/1989 Cox ..... A41D 13/0153 2/2.5
5,052,052 A * 10/1991 Gilford ..... A63B 71/08 2/467
5,101,511 A * 4/1992 Elverskog ..... A41D 13/05 2/92
5,105,473 A * 4/1992 Valtakari ..... A63B 71/08 2/24
5,157,792 A * 10/1992 Allen ..... F41H 1/02 2/92
5,484,448 A * 1/1996 Steele ..... A41D 13/0053 607/108
5,584,737 A * 12/1996 Luhtala ..... F41H 1/02 2/2.5
5,621,914 A * 4/1997 Ramone ..... A41D 13/0518 2/92
5,978,961 A * 11/1999 Barker ..... A41D 13/0518 2/2.5
6,289,524 B1 * 9/2001 Wright ..... A41D 13/015 2/457
6,408,440 B1 * 6/2002 Phillips ..... A41D 13/0518 2/102
6,446,273 B1 * 9/2002 Gillen ..... A41D 13/0153 2/2.5
6,584,619 B1 * 7/2003 Macri ..... A41D 13/0587 2/93
6,859,941 B2 * 3/2005 Koppes ..... A41D 13/01 2/81
6,966,070 B2 * 11/2005 Gillen ..... A41D 13/0518 2/102
7,020,896 B2 * 4/2006 Davis ..... A41D 13/0575 2/69
7,100,216 B2 * 9/2006 Matechen ..... A63B 71/12 2/455
7,100,217 B2 * 9/2006 Panzenbock ..... A41D 13/0531 2/463
7,426,753 B1 * 9/2008 Rivers ..... A41D 31/245 2/2.5
7,937,780 B2 * 5/2011 Matic ..... F41H 1/02 2/465
8,205,273 B2 * 6/2012 Kataoka ..... A41D 13/0518 2/455
8,555,412 B2 * 10/2013 Aquino ..... F41H 1/02 2/2.5
8,776,262 B2 * 7/2014 Blauer ..... F41H 1/02 2/92
8,904,562 B2 * 12/2014 Aquino ..... F41H 1/02 2/2.5
8,966,668 B2 * 3/2015 Sutton ..... A41D 13/08 2/2.5
8,997,267 B2 * 4/2015 Skottheim ..... A41D 13/015 2/463
9,386,811 B1 * 7/2016 Hozen ..... A41B 1/08
9,427,033 B2 * 8/2016 Blakely ..... A41D 13/0518
9,513,089 B2 * 12/2016 Aquino ..... B32B 5/024
9,513,090 B2 * 12/2016 Aquino ..... F41H 5/0471
9,669,281 B2 * 6/2017 Jourde ..... A63B 71/12
9,854,856 B1 * 1/2018 Baldonado ..... A41D 1/04
10,094,640 B2 * 10/2018 Aquino ..... F41H 5/0471
10,357,068 B2 * 7/2019 Byrne ..... A41D 27/201
10,383,376 B1 * 8/2019 Baldonado ..... A41D 1/04
10,455,869 B1 10/2019 Dille et al.
10,485,272 B2 * 11/2019 Blauer ..... A41D 27/02
10,582,731 B2 * 3/2020 Williams ..... B32B 5/028
10,871,351 B2 * 12/2020 Becker ..... F41H 1/02
11,117,012 B2 * 9/2021 Petrakis ..... A41D 31/125
2002/0152533 A1 * 10/2002 Lesley ..... A41D 13/01 2/102
2005/0075046 A1 * 4/2005 Williams ..... A41D 13/05 450/1
2006/0277647 A1 * 12/2006 Dobkin ..... A41D 13/05 2/69
2007/0299489 A1 * 12/2007 Francis ..... A41D 31/12 607/108
2008/0040831 A1 * 2/2008 Nilforushan ..... A61F 7/02 219/211
2008/0201828 A1 * 8/2008 Kanavage ..... A41D 13/015 2/463
2010/0024089 A1 * 2/2010 Turner ..... A41D 13/05 2/243.1
2010/0024100 A1 * 2/2010 Sokolowski ..... A41D 13/0562 2/455
2010/0024101 A1 * 2/2010 Berner, Jr. ..... A41D 13/05 2/243.1
2010/0199406 A1 * 8/2010 Dua ..... B32B 5/06 2/243.1
2010/0287690 A1 11/2010 Kanavage
2010/0306908 A1 * 12/2010 Fiegener ..... A41D 13/0512 2/463
2011/0023201 A1 * 2/2011 Pearl ..... F41H 1/02 2/2.5
2011/0252549 A1 * 10/2011 Jourde ..... A41D 13/0518 2/463
2012/0174273 A1 * 7/2012 Frost ..... F41H 1/02 2/2.5
2013/0152290 A1 * 6/2013 Chou ..... A41D 13/0575 2/463
2013/0291268 A1 * 11/2013 Whaley ..... F41H 1/02 2/2.5
2014/0000016 A1 * 1/2014 Storelli ..... A41D 13/0518 2/463
2014/0130224 A1 * 5/2014 Lurio ..... A41F 3/02 2/2.5
2014/0259333 A1 * 9/2014 Marquez ..... A41D 13/015 2/455
2014/0373243 A1 * 12/2014 Bergeron ..... A41D 1/06 2/2.5
2015/0342329 A1 12/2015 Formosa
2016/0238347 A1 * 8/2016 Blauer ..... A41D 3/005
2017/0181481 A1 * 6/2017 Doumit ..... A41D 27/20
2018/0161617 A1 * 6/2018 Rao ..... A41D 31/00
2019/0037934 A1 * 2/2019 Swank ..... G08B 5/004
2019/0075862 A1 * 3/2019 Ukoli ..... B32B 1/00
2019/0104778 A1 * 4/2019 Giannacco ..... F41H 1/02
2019/0216138 A1 * 7/2019 DiPierro ..... A41D 13/0012
2019/0298565 A1 * 10/2019 Jacobs ..... A41D 27/20
2020/0297050 A1 * 9/2020 Carroll ..... A41D 27/208
2022/0290945 A1 * 9/2022 Blauer ..... A41D 13/0518
2022/0395035 A1 * 12/2022 Leone ..... A41D 13/08
2023/0079499 A1 * 3/2023 Postolek ..... A44B 18/0073 2/270
2023/0200464 A1 * 6/2023 Béland ..... A41D 13/015 2/461

(56) References Cited

U.S. PATENT DOCUMENTS

| | | | | |
|---|---|---|---|---|
| 2023/0292855 | A1* | 9/2023 | Shaffer | A41D 13/0512 2/461 |
| 2024/0017152 | A1* | 1/2024 | Beauregard | A41D 13/0518 |
| 2024/0206574 | A1* | 6/2024 | O'Brien | A41D 13/0518 |
| 2024/0230280 | A1* | 7/2024 | Isquith | G08B 21/02 |

* cited by examiner

SAFETY VEST WITH PROTECTION PLATES

FIELD OF THE INVENTION

The present invention relates to the field of protective clothing, more specifically, a safety vest with protection plates.

BACKGROUND

For workers in the field of construction, maintenance, trades, and the like it is not uncommon for there to be on-the-job injuries caused by tools and/or construction materials. Hazardous objects such as sharp, blunt, heavy, or fast-moving objects can cause severe injuries to workers. As non-limiting examples, the hazardous object may be a sharp object or a flying object such as a piece of a broken tool. As the largest area of the body, which is also at working-level, the torso and arms are often the areas of the body that are injured from these hazardous objects.

Therefore, what is needed is a torso covering safety garment.

SUMMARY

The safety vest with protection plates may comprise a torso covering garment and a plurality of protective inserts. The safety vest with protection plates may be adapted to protect a user from injury at a job site. The torso covering garment may be adapted to cover at least the user's torso. The plurality of protective inserts may be coupled to the torso covering garment and may provide a barrier between the user and a hazardous object. As non-limiting examples, the hazardous object may be a sharp object or a flying object such as a piece of a broken tool. In some embodiments, the safety vest with protection plates may be adapted to cover the user's arms with a pair of sleeves. The pair of sleeves may provide further protection in the form of a pair of shoulder protectors, a pair of elbow protectors, a pair of forearm protectors, or any combination thereof.

An object of the invention is to cover a user's torso with a torso covering garment.

Another object of the invention is to provide a plurality of protective inserts that couple to the torso covering garment.

A further object of the invention is to provide one or more reflective straps coupled to the exterior surface of the torso covering garment.

Yet another object of the invention is to provide a pair of shoulder protectors, a pair of elbow protectors, a pair of forearm protectors, or any combination thereof.

These together with additional objects, features and advantages of the safety vest with protection plates will be readily apparent to those of ordinary skill in the art upon reading the following detailed description of the presently preferred, but nonetheless illustrative, embodiments when taken in conjunction with the accompanying drawings.

In this respect, before explaining the current embodiments of the safety vest with protection plates in detail, it is to be understood that the safety vest with protection plates is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the safety vest with protection plates.

It is therefore important that the claims be regarded as including such equivalent construction insofar as they do not depart from the spirit and scope of the safety vest with protection plates. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION

Figure 1:
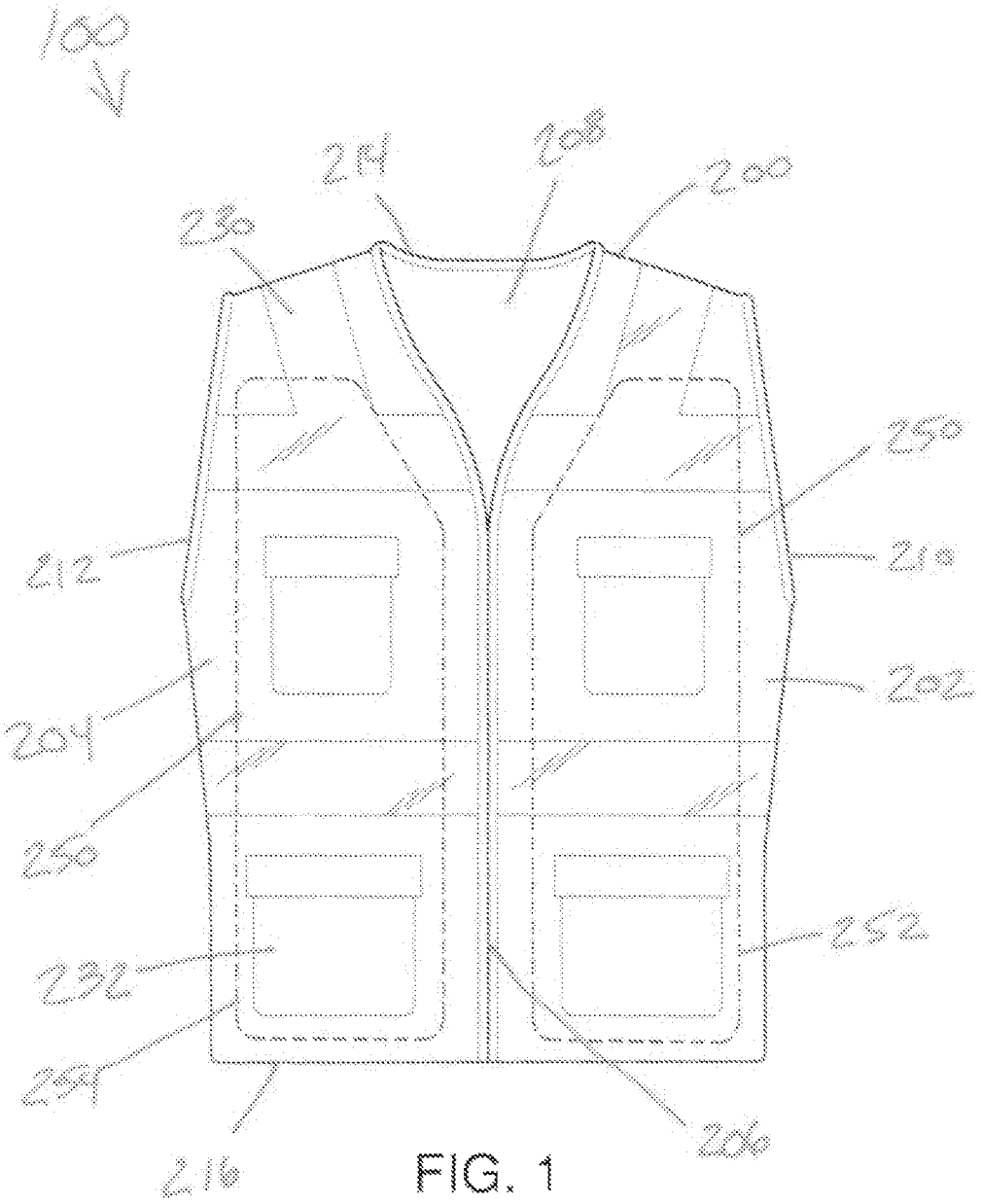
FIG. 1 is a front view of an embodiment of the disclosure.
Figure 2:
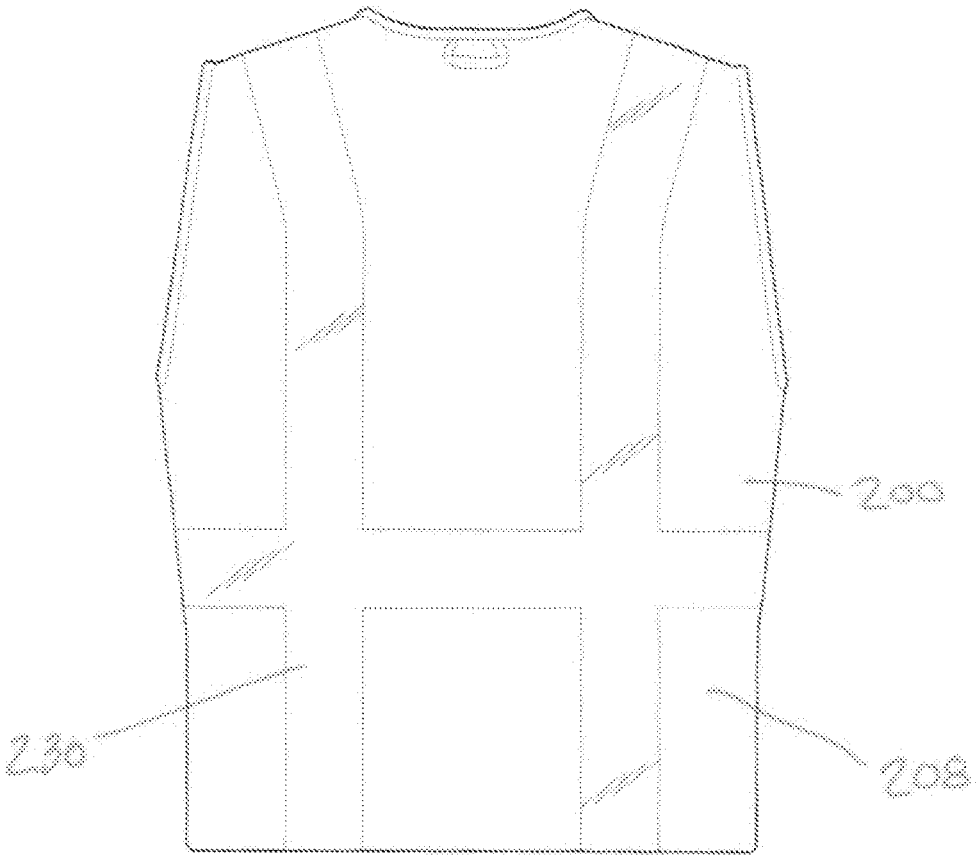
FIG. 2 is a rear view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 4.

The safety vest with protection plates 100 (hereinafter invention) comprises a torso covering garment 200 and a plurality of protective inserts 250. The invention 100 may be adapted to protect a user from injury at a job site. The torso covering garment 200 may be adapted to cover at least the user's torso. The plurality of protective inserts 250 may be coupled to the torso covering garment 200 and may provide a barrier between the user and a hazardous object. As non-limiting examples, the hazardous object may be a sharp object or a flying object such as a piece of a broken tool. In some embodiments, the invention 100 may be adapted to cover the user's arms with a pair of sleeves. The pair of sleeves may provide further protection in the form of a pair of shoulder protectors, a pair of elbow protectors, a pair of forearm protectors, or any combination thereof.

The torso covering garment 200 may comprise a left front panel 202, a right front panel 204 and a rear panel 208. The left front panel 202 may be adapted to cover the left side of the user's torso. The right front panel 204 may be adapted to cover the right side of the user's torso. The rear panel 208 may be adapted to cover the rear of the user's torso. The left side of the left front panel 202 may be coupled to the left side of the rear panel 208 and the right side of the right front panel 204 may be coupled to the right side of the rear panel 208 to define the torso covering garment 200 as a single article of clothing.

The right side of the left front panel 202 may detachably couple to the left side of the right front panel 204 along a vertically-oriented line located at the front center of the torso covering garment 200. The right side of the left front panel 202 and the left side of the right front panel 204 may couple via a front fastener 206. As non-limiting examples, the front fastener 206 may comprise a zipper, one or more hook and loop fasteners, a plurality of buttons, a plurality of clasps, a plurality of snaps, or any combination thereof.

The torso covering garment 200 may comprise a left arm aperture 210 located at the top of the left side of the torso covering garment 200 and a right arm aperture 212 located at the top of the right side of the torso covering garment 200. The left arm aperture 210 may be adapted for the user's left arm to exit the torso covering garment 200 and the right arm aperture 212 may be adapted for the user's right arm to exit the torso covering garment 200. The torso covering garment 200 may comprise a neck aperture 214 located at the top center of the torso covering garment 200. The neck aperture 214 may be adapted for the user's neck to pass through the torso covering garment 200. The torso covering garment 200 may comprise a waist aperture 216 located at the bottom center of the torso covering garment 200. The waist aperture 216 may be adapted to surround the user's waist.

The torso covering garment 200 may be adapted to be donned by opening the front fastener 206, sliding the user's left arm through the left arm aperture 210, sliding the user's right arm through the right arm aperture 212, and closing the front fastener 206. The torso covering garment 200 may be adapted to be removed by opening the front fastener 206, sliding the user's left arm out of the left arm aperture 210, and sliding the user's right arm out of the right arm aperture 212.

A plurality of protective insert retainers 220 may be operable to couple the plurality of protective inserts 250 to the torso covering garment 200. In some embodiments, the plurality of protective insert retainers 220 may comprise pockets that the plurality of protective inserts 250 may slide into. The pockets may be coupled to the inside of the torso covering garment 200 such that the plurality of protective inserts 250 may be hidden from view. The plurality of protective inserts 250 may be removeable and replaceable. In some embodiments, the plurality of protective insert retainers 220 may comprise fabric panels that are larger than the plurality of protective inserts 250 such that the plurality of protective inserts 250 are sandwiched between the torso covering garment 200 and the fabric panel into the torso covering garment 200 by stitching the perimeter of the fabric panel to the torso covering garment 200.

In some embodiments, the torso covering garment 200 may comprise one or more reflective straps 230 that may be coupled to the exterior surface of the torso covering garment 200. The one or more reflective straps 230 may be adapted to increase visibility of the torso covering garment 200, and therefore, the user. As a non-limiting example, the one or more reflective straps 230 may comprise retroreflector technology to reflect a light beam back towards the source of the light beam.

In some embodiments, the torso covering garment 200 may comprise one or more front pockets 232. The one or more front pockets 232 may be operable to store small items. As non-limiting examples, the one or more front pockets 232 may store pens, pencils, notepads, a pocket knife, small tools, or any combination thereof. The plurality of protective inserts 250 may be rigid or semi-rigid plates that are shaped to fit into the plurality of protective insert retainers 220. A front left protective insert 252 may be coupled to the left front panel 202 and a front right protective insert 254 may be coupled to the right front panel 204. The plurality of protective inserts 250 may be adapted to deflect the hazardous objects that are directed towards the user's torso.

Figure 3:
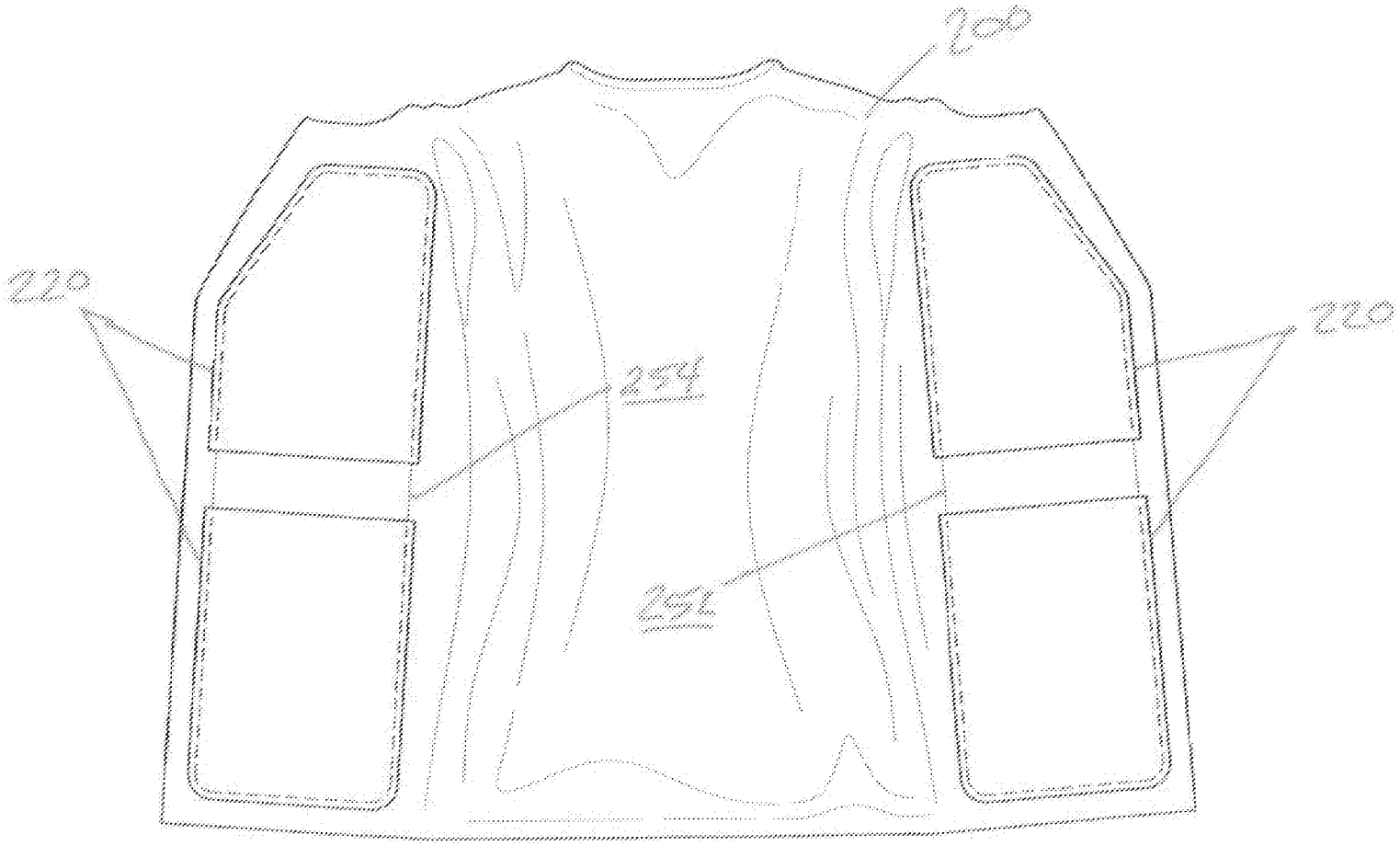
FIG. 3 is a front view of an embodiment of the disclosure, illustrating the torso covering garment opened.
Figure 4:
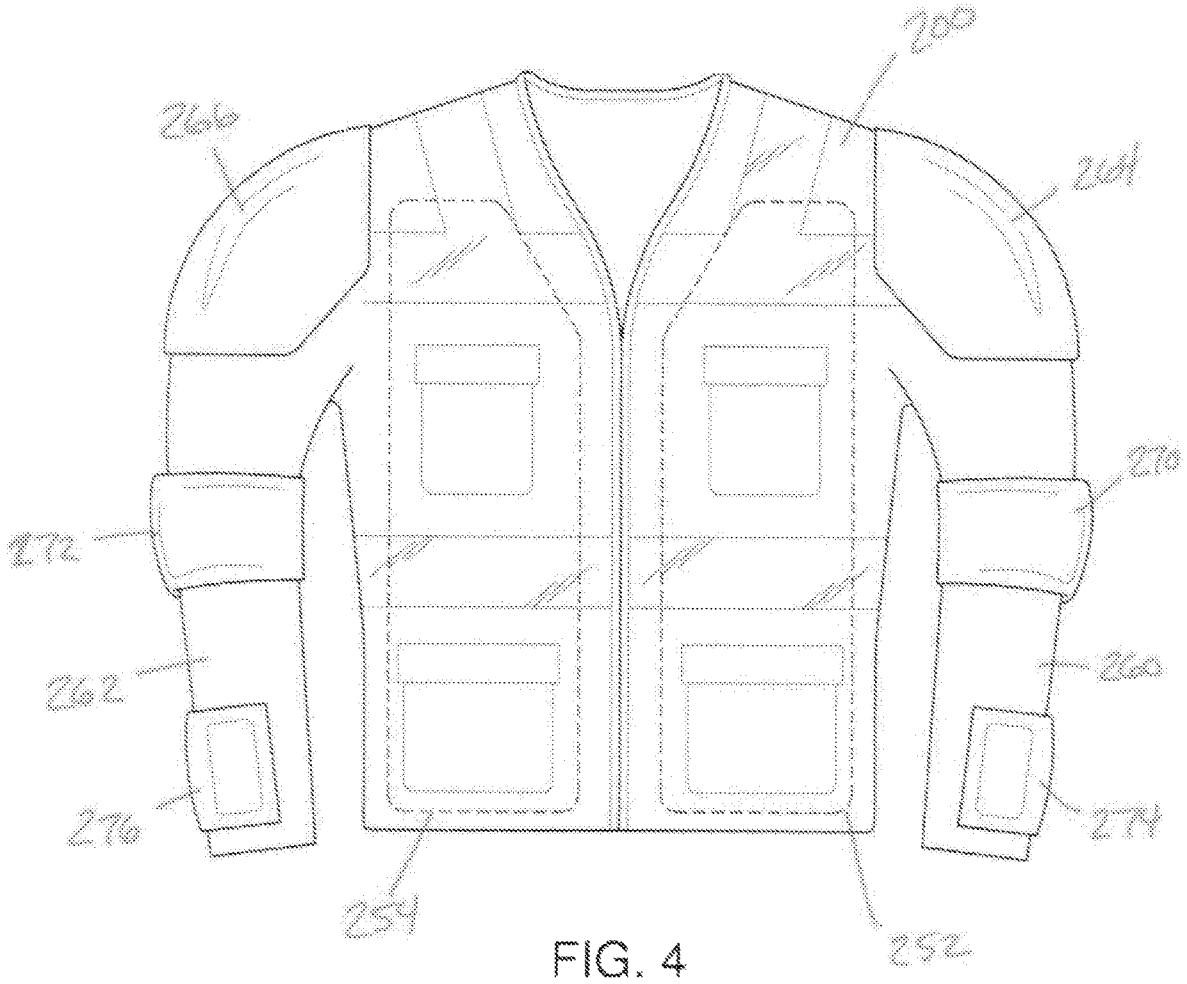
FIG. 4 is a front view of an alternative embodiment of the disclosure.

As shown in FIG. 3, each pair of the protective insert retainers 220 may include an upper pocket and a lower pocket. In some embodiments, the upper pocket may include a lower edge, at which a first opening may be located; the lower pocket may include an upper edge, at which a second opening may be located. The first and the second opening may be spaced from each other along a length of the safety vest. In some embodiments, the protective inserts 254 and 252 may both be single-pieced plates, with their upper parts inserted into the upper pockets, and lower parts inserted into the lower pockets.

The plurality of protective inserts 250 may be made from thermoplastic, composite resin, metal, or any combination thereof. In a preferred embodiment, the plurality of protective inserts 250 may be made from high density polyethylene (HOPE).

In a preferred embodiment, the torso covering garment 200 may be a vest that is sleeveless. In alternative embodiments, the torso covering garment 200 may comprise a pair of sleeves. A left sleeve 260 may be coupled to the left arm aperture 210 and a right sleeve 262 may be coupled to the right arm aperture 212.

In some embodiments, the torso covering garment 200 may comprise a pair of shoulder protectors. The pair of shoulder protectors may be adapted to protect the user's shoulders. A left shoulder protector 264 selected from the pair of shoulder protectors may be coupled to the left shoulder of the torso covering garment 200. A right shoulder protector 266 selected from the pair of shoulder protectors may be coupled to the right shoulder of the torso covering garment 200. The pair of shoulder protectors may be adapted to conform to the shape of the user's shoulders.

In some embodiments, the torso covering garment 200 may comprise a pair of elbow protectors. The pair of elbow protectors may be adapted to protect the user's elbows. A left elbow protector 270 selected from the pair of elbow protectors may be coupled to the middle of the left sleeve 260 of the torso covering garment 200. A right elbow protector 272 selected from the pair of elbow protectors may be coupled to the middle of the right sleeve 262 of the torso covering garment 200. The pair of elbow protectors may be adapted to surround the middle of the pair of sleeves.

In some embodiments, the torso covering garment 200 may comprise a pair of forearm protectors. The pair of forearm protectors may be adapted to protect the user's forearms. A left forearm protector 274 selected from the pair of forearm protectors may be coupled to the distal end of the left sleeve 260 of the torso covering garment 200. A right forearm protector 276 selected from the pair of forearm protectors may be coupled to the distal end of the right sleeve 262 of the torso covering garment 200. The pair of forearm protectors may be adapted to couple to the top of the distal ends of the pair of sleeves.

In use, the torso covering garment 200 may be donned by opening the front fastener 206 sliding the user's arms one at a time through the left arm aperture 210 and the right arm aperture 212, and closing the front fastener 206. The plurality of protective inserts 250 within the torso covering garment 200 may protect the user from hazardous objects. As non-limiting examples, the hazardous objects may comprise sharp objects directed at the user's torso and the flying objects such as shrapnel ejected from the broken tool.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, the word "exterior" may be used as a relational term that implies that an object is not located or contained within the boundary of a structure or a space.

As used in this disclosure, a "fastener" may be a device that is used to join or affix two objects. Fasteners may generally comprise a first element which is attached to the first object and a second element which is attached to the second object such that the first element and the second element join to affix the first object and the second object. Common fasteners may include, but are not limited to, hooks, zippers, snaps, clips, ties, buttons, buckles, quick release buckles, or hook and loop fasteners.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "hook and loop fastener" may be a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks may couple to the plurality of loops securely fastening the hook surface to the loop surface. The hook surface may sometime be referred to as a hard side fastener and the loop surface may sometimes be referred to as a soft side fastener.

As used in this disclosure, a "perimeter" may be one or more curved or straight lines that bound an enclosed area on a plane or surface. The perimeter of a circle is commonly referred to as a circumference.

As used in this disclosure, a "pocket" may be a pouch or storage space that is formed into an object. Pockets are often formed by joining a second textile or a second sheeting to a first textile or a first sheeting, respectively, by sewing or heat sealing respectively.

As used herein, "resilient" or "semi-rigid" may refer to an object or material which may deform when a force is applied to it and which will return to its original shape when the deforming force is removed.

As used herein, "retroreflective" may refer to a property of an object that reflects light back to the light source with minimal scattering. A retroreflective device may be referred to as a "retroreflector". A retroreflector may reflect light back to the light source over a wide range of angle of incidence.

As used herein, "rigid" may refer to an object or material which is inflexible.

As used in this disclosure, a "sleeve" may be a tube like covering that is placed over or around a rod, shaft, cable, or other cylindrical object.

As used in this disclosure, "vertical" may refer to a direction that is parallel to the local force of gravity. Unless specifically noted in this disclosure, the vertical direction is always perpendicular to horizontal.

As used in this disclosure, a "vest" may be a sleeveless garment that is worn over the torso.

As used in this disclosure, a "zipper" may be a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A safety vest comprising:

a torso covering garment and a plurality of protective inserts;

wherein the safety vest is adapted to protect a user from injury at a job site;

wherein the torso covering garment is adapted to cover at least the user's torso;

wherein the plurality of protective inserts are coupled to the torso covering garment and provide a barrier between the user and a hazardous object;

wherein the plurality of protective inserts includes a left-front protective insert and a right-front protective insert;

wherein, a first pair of protective insert retainers, respectively located inside an upper left front part and a lower left front part of the torso covering garment, is operable to couple the left-front protective insert to the torso covering garment;

wherein, a second pair of protective insert retainers, respectively located inside an upper right front part and a lower right front part of the torso covering garment, is operable to couple the right-front protective insert to the torso covering garment;

wherein each of the first and second pairs of protective inset retainers includes an upper pocket and a lower pocket;

wherein the upper pocket includes a lower edge, at which the upper pocket has a first opening, and the lower pocket includes an upper edge, at which the lower pocket has a second opening;

wherein, the lower edge of the upper pocket and the upper edge of the lower pocket are spaced from each other along a length of the safety vest;

wherein the left-front and right-front protective inserts are rigid;

wherein each of the left-front and right-front protective inserts is a single-pieced plate;

wherein the left-front and right-front protective inserts are configured to be removably inserted into the first and second pairs of protective inset retainers through the first and second openings;

wherein an upper part of each of the left-front and right-front protective inserts is inserted into the upper pocket via the first opening, and a lower part of each of the left-front and right-front protective inserts can be is inserted into the lower pocket via the second opening.

2. The safety vest according to claim 1, wherein the torso covering garment comprises a left front panel, a right front panel, and a rear panel;

wherein the left front panel is adapted to cover the left side of the user's torso;

wherein the right front panel is adapted to cover the right side of the user's torso;

wherein the rear panel is adapted to cover the rear of the user's torso;

wherein a left side of the left front panel is coupled to a left side of the rear panel and a right side of the right front panel is coupled to a right side of the rear panel to define the torso covering garment as a single article of clothing.

3. The safety vest according to claim 2, wherein the right side of the left front panel detachably couples to the left side of the right front panel along a vertically-oriented line located at a front center of the torso covering garment;

wherein the right side of the left front panel and the left side of the right front panel are coupled via a front fastener.

4. The safety vest according to claim 3, wherein the front fastener comprises a zipper, one or more hook and loop fasteners, a plurality of buttons, a plurality of clasps, a plurality of snaps, or any combination thereof.

5. The safety vest according to claim 3, wherein the torso covering garment comprises a left arm aperture located at a top of a left side of the torso covering garment and a right arm aperture located at a top of a right side of the torso covering garment;

wherein the left arm aperture is adapted for the user's left arm to exit the torso covering garment and the right arm aperture is adapted for the user's right arm to exit the torso covering garment;

wherein the torso covering garment comprises a neck aperture located at a top center of the torso covering garment;

wherein the neck aperture is adapted for the user's neck to pass through the torso covering garment;

wherein the torso covering garment comprises a waist aperture located at a bottom center of the torso covering garment;

wherein the waist aperture is adapted to surround the user's waist.

6. The safety vest according to claim 1, wherein the plurality of protective inserts is removeable and replaceable.

7. The safety vest according to claim 1, wherein the plurality of protective insert retainers includes fabric panels that are larger than the plurality of protective inserts such that the plurality of protective inserts is sandwiched between the torso covering garment and the fabric panel into the torso covering garment by stitching the perimeter of the fabric panel to the torso covering garment.

8. The safety vest according to claim 1, wherein the torso covering garment comprises one or more reflective straps that are coupled to the exterior surface of the torso covering garment;

wherein the one or more reflective straps are adapted to increase visibility of the torso covering garment.

9. The safety vest according to claim 8, wherein the torso covering garment comprises one or more front pockets;

wherein the one or more front pockets are operable to store items.

10. The safety vest according to claim 9, wherein the plurality of protective inserts is rigid plates that are shaped to fit into the plurality of protective insert retainers;

wherein the left-front protective insert is coupled to the left front panel and the right-front protective insert is coupled to the right front panel;

wherein the plurality of protective inserts is adapted to deflect the hazardous objects that are directed towards the user's torso.

11. The safety vest according to claim 10, wherein the plurality of protective inserts is made from thermoplastic, composite resin, metal, or any combination thereof.

12. The safety vest according to claim 11, wherein the plurality of protective inserts is made from high density polyethylene.

13. The safety vest according to claim 10, wherein the torso covering garment is a vest that is sleeveless.

14. The safety vest according to claim 10, wherein the torso covering garment comprises a pair of sleeves;

wherein a left sleeve is coupled to the left arm aperture and a right sleeve is coupled to the right arm aperture.

15. The safety vest according to claim 14, wherein the torso covering garment comprises a pair of shoulder protectors;

wherein the pair of shoulder protectors is adapted to protect the user's shoulders;

wherein a left shoulder protector selected from the pair of shoulder protectors is coupled to the left shoulder of the torso covering garment;

wherein a right shoulder protector selected from the pair of shoulder protectors is coupled to the right shoulder of the torso covering garment;

wherein the pair of shoulder protectors is adapted to conform to the shape of the user's shoulders.

16. The safety vest according to claim 14, wherein the torso covering garment comprises a pair of elbow protectors;

wherein the pair of elbow protectors is adapted to protect the user's elbows;

wherein a left elbow protector selected from the pair of elbow protectors is coupled to the middle of the left sleeve of the torso covering garment;

wherein a right elbow protector selected from the pair of elbow protectors is coupled to the middle of the right sleeve of the torso covering garment;

wherein the pair of elbow protectors is adapted to surround the middle of the pair of sleeves.

17. The safety vest according to claim 14, wherein the torso covering garment comprises a pair of forearm protectors;

wherein the pair of forearm protectors is adapted to protect the user's forearms;

wherein a left forearm protector selected from the pair of forearm protectors is coupled to a distal end of the left sleeve of the torso covering garment;

wherein a right forearm protector selected from the pair of forearm protectors is coupled to a distal end of the right sleeve of the torso covering garment;

wherein the pair of forearm protectors is adapted to couple to a top of the distal ends of the pair of sleeves.

* * * * *